US007449663B2

(12) United States Patent
Kagan et al.

(10) Patent No.: US 7,449,663 B2
(45) Date of Patent: Nov. 11, 2008

(54) INDUCTIVE HEATING APPARATUS AND METHOD

(75) Inventors: Valery Kagan, Colchester, VT (US); Kyle B. Clark, Underhill, VT (US); Wayne N. Collette, Merrimack, NH (US); Stefan von Buren, Colchester, VT (US)

(73) Assignee: iTherm Technologies, L.P., Merrimack, NH (US)

( * ) Notice: Subject to any disclaimer, the term of this patent is extended or adjusted under 35 U.S.C. 154(b) by 50 days.

(21) Appl. No.: 11/505,023

(22) Filed: Aug. 16, 2006

(65) Prior Publication Data

US 2008/0053985 A1 Mar. 6, 2008

(51) Int. Cl.
*H05B 6/38* (2006.01)
*H05B 6/02* (2006.01)

(52) U.S. Cl. ..... 219/632; 219/635; 219/644; 219/672; 219/677; 264/403

(58) Field of Classification Search ..... 219/632, 219/633, 635, 644, 643, 649, 650, 672–677; 425/174–175; 264/403, 472, 486
See application file for complete search history.

(56) References Cited

U.S. PATENT DOCUMENTS

| | | | | |
|---|---|---|---|---|
| 1,852,215 | A | 4/1932 | Northrup | |
| 2,829,227 | A | 4/1958 | Antonis | |
| 2,875,311 | A * | 2/1959 | Harkenrider | 219/618 |
| 3,376,403 | A * | 4/1968 | Mircea | 219/618 |
| 3,536,983 | A | 10/1970 | Kennedy | |
| 4,704,509 | A | 11/1987 | Hilmersson et al. | |
| 5,012,487 | A | 4/1991 | Simcock | |
| 5,101,086 | A | 3/1992 | Dion | |
| 5,713,069 | A | 1/1998 | Kato | |
| 5,902,509 | A * | 5/1999 | Bruckner et al. | 219/644 |
| 6,084,225 | A | 7/2000 | Schmitt | |
| 6,460,596 | B1 | 10/2002 | Yamaguchi et al. | |
| 6,546,039 | B2 | 4/2003 | Fishman | |

(Continued)

FOREIGN PATENT DOCUMENTS

DE 965761 6/1957

(Continued)

OTHER PUBLICATIONS

International Search Report and Written Opinion mailed Dec. 28, 2007 in related application Serial No. PCT/US2007/018113 (U.S. Appl. No. 11/505,032).

(Continued)

*Primary Examiner*—Philip H Leung
(74) *Attorney, Agent, or Firm*—Rissman, Jobse, Hendricks & Oliverio LLP

(57) ABSTRACT

Apparatus and method for inductive heating wherein an internal inductive heating assembly is provided within a bore of a solid article. The heating assembly includes an interior coil inductively coupled to a portion of the article adjacent the bore to inductively heat the article. The heating assembly lacks an internal cooling mechanism and the coil thermally coupled to the adjacent article portion for transmission of heat from the coil to the article. A signal is provided to the coil to generate a magnetic flux for inductive heating of the adjacent article portion.

19 Claims, 1 Drawing Sheet

U.S. PATENT DOCUMENTS

| | | | | |
|---|---|---|---|---|
| 6,798,822 | B2 | 9/2004 | Fishman et al. | |
| 6,892,790 | B2 | 5/2005 | Czerwinski et al. | |
| 7,034,263 | B2 | 4/2006 | Kagan | |
| 7,034,264 | B2 | 4/2006 | Kagan | |
| 7,049,562 | B2 | 5/2006 | Tanino et al. | |
| RE39,291 | E | 9/2006 | Kestle et al. | |
| 7,140,873 | B1 | 11/2006 | House | |
| 2002/0189781 | A1* | 12/2002 | Shibata et al. | 164/113 |
| 2003/0057201 | A1 | 3/2003 | Johnson | |
| 2003/0067376 | A1 | 4/2003 | Maenosono | |
| 2003/0132224 | A1 | 7/2003 | Spencer | |
| 2004/0028111 | A1 | 2/2004 | Fishman et al. | |
| 2005/0191098 | A1 | 9/2005 | Ueno et al. | |
| 2006/0076338 | A1 | 4/2006 | Kagan | |
| 2006/0093413 | A1 | 5/2006 | Matsumoto | |

FOREIGN PATENT DOCUMENTS

| | | | |
|---|---|---|---|
| DE | 3118030 | | 12/1982 |
| DE | 102005021238 | | 11/2006 |
| EP | 0403138 | A | 12/1990 |
| GB | 508255 | A | 6/1939 |
| JP | 1-170547 | | 7/1989 |
| JP | 2004 108666 | A | 4/2004 |
| JP | 2005 259558 | | 9/2005 |

OTHER PUBLICATIONS

International Search Report and Written Opinion mailed Apr. 24, 2008 in a related application Serial No. PCT/US2007/018071 (U.S. Serial No. 11/505,022).

International Search Report and Written Opinion mailed Dec. 20, 2007 in a related application Serial No. PCT/US2007/018125 (U.S. Appl. No. 11/505,059).

International Search Report and Written Opinion mailed Mar. 26, 2008 in a corresponding application Serial No. PCT/US2007/018041 (U.S. Appl. No. 11/505,023).

* cited by examiner

INDUCTIVE HEATING APPARATUS AND METHOD

FIELD OF THE INVENTION

This invention relates to an apparatus and method for inductive heating, wherein an internal inductive heating assembly is provided within a bore of a solid article, for inductively heating a portion of the article adjacent the bore and conductively transmitting heat from the assembly to the article.

BACKGROUND OF THE INVENTION

It is common practice to inductively heat an article (e.g., a solid cylinder or hollow tube) of a magnetizable material, such as steel, by inducing an eddy current in the article. This eddy current is induced by an applied magnetic flux generated by passage of an alternating current through a heater coil wound around the article. The heat inductively generated in the article may then be transmitted to another article, e.g., a metal or polymer material flowing through a bore or channel of an inductively heated steel tube.

Various systems have been proposed which utilize different combinations of materials, structural heating elements, resonant frequencies, etc., for such heating techniques. There is an ongoing need for an apparatus and method for heating a material in a channel which provides one or more of higher power density, tighter temperature control, reduced power consumption, longer operating life, and/or lower manufacturing costs.

SUMMARY OF THE INVENTION

In accordance with one embodiment of the invention, a method is provided for heating a solid article, including the steps of providing an internal inductive heating assembly within a bore of the solid article. The assembly includes an interior coil inductively coupled to a portion of the article adjacent the bore, to inductively heat the adjacent article portion. A signal is supplied to the coil to generate a magnetic flux for inductive heating of the adjacent article portion. The assembly lacks an internal cooling mechanism and the coil is thermally coupled to the adjacent article portion for transmission of heat from the coil to the article.

In various embodiments, the heating assembly may further include a flux concentrator to increase the inductive coupling between the coil and the adjacent article portion. The flux concentrator may be disposed radially inwardly of the coil.

The coil may be disposed in a dielectric thermally-conductive material, such as a cast and/or packed body of ceramic.

The signal supplied to the coil may be adjusted to vary the relative amounts of inductive heating and thermally coupled heat transmission to the article. The signal may be adjusted to maintain the coil temperature to within defined operating limits. The signal may further be adjusted to provide alternating heating and cooling cycle. The coil may stabilize in temperature during the cooling portion of the cycle.

The solid article may be a ferromagnetic material.

An air gap may be provided between the assembly and the bore within a range of $1/1000$ to $30/1000$ inches.

Alternatively, the assembly may include a substantially paramagnetic and electrically insulative outer cover over a dielectric material surrounding the coil.

In other embodiments, an electrically non-conductive, thermally conductive flowable material may be provided between the heating assembly and the bore. Aternatively, a (stationary) fill material may be provided in the gap between the heater assembly and bore, also electrically non-conductive and thermally conductive.

In accordance with another embodiment of the invention, an internal inductive heating assembly is positionable within a bore of a solid article, the assembly including an interior coil for inductive coupling to a portion of the article adjacent the bore, and a conductor for supplying a signal to the coil to generate a magnetic flux for inductive heating of the adjacent article portion. The interior coil is disposed in a cast and/or packed body of a dielectric and thermally conductive material. The assembly lacks an internal cooling mechanism and the coil is thermally coupled to the adjacent article portion for transmission of heat from the coil to the article.

A substantially paramagnetic and electrically insulative outer cover may be provided over the dielectric material surrounding the coil.

These and other features and/or advantages of several embodiments of the invention may be better understood by referring to the following detailed description in conjunction with the accompanying drawings.

DETAILED DESCRIPTION

In accordance with one embodiment of the invention, an inductive cartridge heater is provided within a bore of a solid article. The heater assembly includes a coil inductively coupled to a portion of the article adjacent the bore, whereby the article is inductively heated. This internal inductive heating assembly can be used where there is an air gap between the apparatus and the bore of the article in a range of $1/1000$ to $30/1000$ inches, in other words without the required close tolerance and intimate contact required in the prior art systems.

Figure 1:
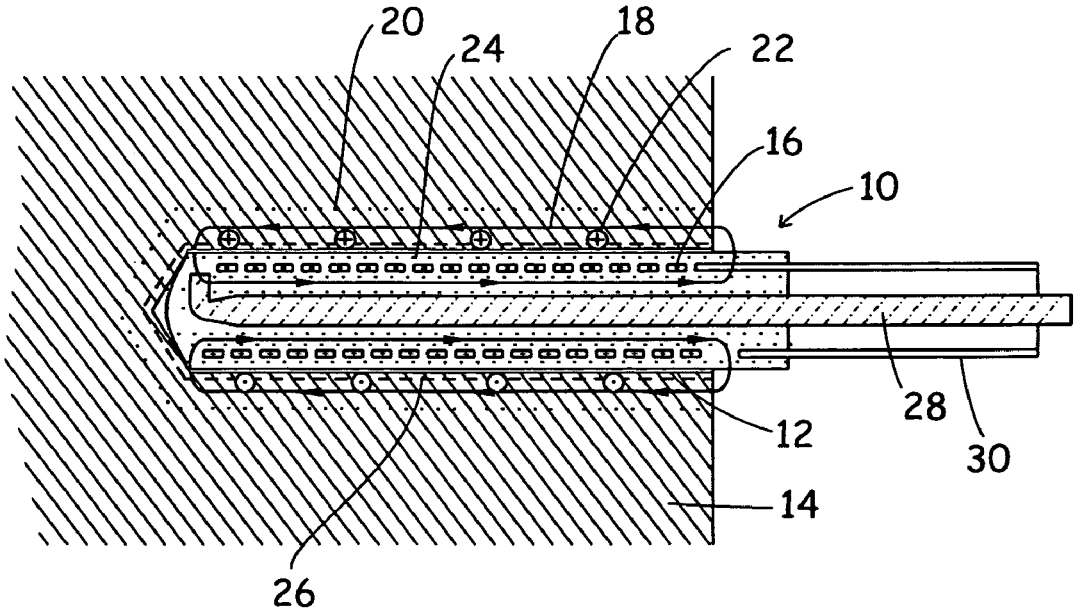
FIG. 1 is a schematic view of one embodiment of an inductive heating assembly disposed within a bore of a solid ferromagnetic article.

FIG. 1 shows one embodiment of an inductive heating assembly 10 disposed within a bore 12 of a solid ferromagnetic article 14. The coil 16 of the heating assembly generates a magnetic flux 18 in a portion of the ferromagnetic article surrounding the bore (shown by dashed outline 20). The flux generates an eddy current 22 in that article portion and thus inductively heats the article portion 20. The coil is surrounded by a dielectric material 24, providing electrical isolation between the coil 16 and ferromagnetic article 14. Preferably, the dielectric is a ceramic body in which the coil is embedded. Optionally, the heating assembly may further include a substantially non-magnetic and non-electrically conductive outer cover over the dielectric (shown as dashed outline 26 in FIG. 1). However, it is preferred that the dielectric body 24 comprise the outermost element, and that it is highly thermally conductive, in order to enhance transmission of heat generated in the coil to the article (and/or maintain the temperature of the coil within defined operating limits).

The assembly 10 has a generally elongated cylindrical profile adapted to be disposed within the bore 12. The assembly includes coaxial power leads 28, 30, protruding from one end of the assembly, which supply a signal to coil 16 for generating the magnetic flux.

As previously discussed, an air gap may be provided between the outside surface of the induction heating assembly and the internal surface of the article bore. Preferably, the gap is sized to provide thermal communication between the outer assembly surface and the internal bore surface in order to transfer parasitic heat generated in the coil to the article. Parasitic heat is heat generated in the coil, which reduces the inductive power delivery. Generally, in an inductive heating apparatus it is desirable that at least 85% of the power be utilized inductively with only a 15% parasitic power loss, and more preferably, when a flux concentrator is used, it is desirable that the parasitic power loss be no greater than 5%. The 5% power loss is based on the power supplied to the coil.

The maximum allowable air gap, preferably in the range of $1/1{,}000$ to $30/1{,}000$ inches, and more preferably $2/1{,}000$ to $20/1{,}000$ inches, is dependent upon the power density and operating temperature, as well as the coil material. For example, with a high power density of 300 W/cm$^2$, a high coil temperature of 600° C., and with relatively good coupling (e.g., ratio of parasitic power:total power=10%) and a nickel coil, the gap is preferably on the low end of the $1/1{,}000$-$30/1{,}000$ range, e.g., $5/1{,}000$ or less. On the contrary, if the application is for a low power density such as 30 W/cm$^2$, at a mid-level temperature of 300° C., with good coupling and a copper coil, the allowable gap may be from $2/1{,}000$ to $20/1{,}000$ inches. Each of these gap ranges may provide sufficient thermal communication from the coil to the article to maintain the coil temperature below its maximum rated temperature, in a given application.

In one embodiment, the method may include providing an electrically non-conductive flowable material (e.g., a polymer melt) between the heating assembly and the bore. This flowable material does not substantially interfere with the coupling of the coil and outer element, and the flowable material may be heated by transmission of heat from the outer element and/or the coil. The flowable material may be considered an extension of the dielectric layer, in terms of its effect on thermal conductivity.

In another embodiment, a stationary film material is provided in the gap between the heating assembly and the bore, again a thermally conductive and non-electrically conductive material. Suitable materials include aluminum nitride and magnesium oxide powder.

Figure 2:
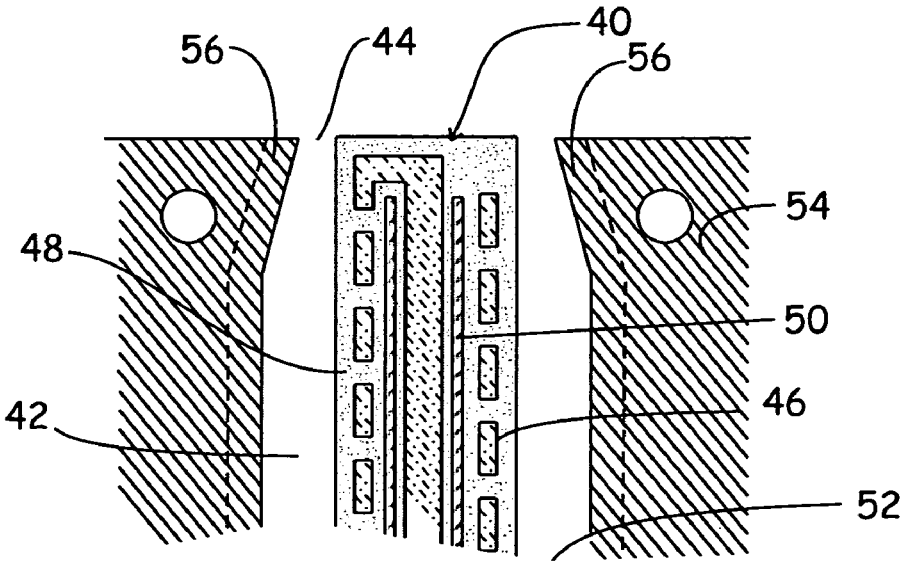
FIG. 2 is a schematic view of another inductive heating assembly disposed in a channel of a ferromagnetic nozzle, wherein a nonconductive fluid material flows between the heating assembly and nozzle.

FIG. 2 illustrates this second embodiment of a heater assembly 40 for heating of a non-conductive fluid material 42 (e.g., polymer in a gate region 44 of an injection molding apparatus.

The high permeability flux concentrator 50 enhances the magnetic field by forming a closed magnetic loop with the adjacent article portion 56, thus increasing the magnetic coupling between the coil 46 and article portion 56. The flux concentrator preferably has an open current loop (e.g., slotted as shown) to reduce the eddy currents (and thus heat) generated in the flux concentrator.

The heater assembly according to the present invention is not limited to specific materials, shapes or configurations of the components thereof. A particular application or environment will determine which materials, shapes and configurations are suitable.

For example, the inductor coil may be one or more of nickel, silver, copper and nickel/copper alloys. A nickel (or high percentage nickel alloy) coil is suitable for higher temperature applications (e.g., 500 to 1,000° C.). A copper (or high percentage copper alloy) coil may be sufficient for lower temperature applications (e.g., <500° C.). The coil may be stainless steel or Inconel (a nickel alloy). In the various embodiments described herein, water cooling of the coil is not required or desirable.

The power leads supplying the inductor coil may comprise an outer cylindrical supply lead and an inner return lead concentric with the outer cylindrical supply lead. The leads may be copper, nickel, Litz wire or other suitable materials.

The dielectric insulation surrounding the inductor coil may be a ceramic such as one or more of magnesium oxide, alumina, and mica. The dielectric may be provided as a powder, sheet or a cast body surrounding the coil.

The coil may be cast on a ceramic dielectric core, and a cast and/or packed ceramic provided as a dielectric layer over the coil.

The solid article to be heated may be made from a ferromagnetic metal, such as a 400 series steel or a tool steel.

The flux concentrator may be provided as a tubular element disposed between the coil and the return lead. The flux concentrator may be a solid, laminated and/or slotted element. For low temperature applications, it may be made of a non-electrically conductive ferromagnetic material, such as ferrite. For higher temperature applications it may comprise a soft magnetic alloy (e.g., cobalt).

The coil geometry may take any of various configurations, such as serpentine or helical. The coil cross-section may be flat, round, rectangular or half round. As used herein, coil is not limited to a particular geometry or configuration; a helical wound coil of flat cross section as shown is only one example.

As used herein, heating includes adjusting, controlling and/or maintaining the temperature of a solid article.

Again, the specific materials, sizes, shapes and configurations of the various components will be selected depending upon the particular material to be heated, the cycle time, and other process parameters.

In various applications of the described inductive heating method and apparatus, it may generally be desirable that the various components have the following properties:

- the coil is electrically conductive, can withstand a designated operating temperature, and is paramagnetic at the operating temperature;
- the solid article is ferromagnetic at the desired operating temperature, is thermally conductive, is electrically conductive, and has a relatively uninterrupted path for the eddy current to flow;
- the dielectric material is electrically insulative, thermally conductive, and substantially completely paramagnetic;
- the flux concentrator does not exceed its Curie point during operation, has a high permeability, can withstand high operating temperatures, and has an interrupted (restricted) circumferential path for the eddy current to flow;
- the matierial is in good thermal contact with the sheath.

In one application, the bore is provided in an injection molding system, and more particularly in the gate area of an injection nozzle. The bore may be provided in a gate insert of the nozzle. The gate insert may include an active cooling line.

In various applications, it may be desirable to supply a signal to the coil comprising current pulses having a desired amount of pulse energy in high frequency harmonics for inductive heating of the sheath, as described in Kagan U.S. Pat. Nos. 7,034,263 and 7,034,264, and in Kagan U.S. Patent Application Publication No. 2006/0076338 A1, published Apr. 13, 2006 (U.S. Ser. No. 11/264,780, entitled Method and Apparatus for Providing Harmonic Inductive Power). The current pulses are generally characterized as discrete narrow width pulses, separated by relatively long delays, wherein the pulses contain one or more steeply varying portions (large first derivatives) which provide harmonics of a fundamental (or root) frequency of the current in the coil. Preferably, each pulse comprises as least one steeply varying portion for delivering at least 50% of the pulse energy in the load circuit in high frequency harmonics. For example, the at least one steeply varying portion may have a maximum rate of change of at least five times greater than the maximum rate of change of a sinusoidal signal of the same fundamental frequency and RMS current amplitude. More preferably, each current pulse contains at least two complete oscillation cycles before damping to a level below 10% of an amplitude of a maximum peak in the current pulse. A power supply control apparatus is described in the referenced patents/application which includes a switching device that controls a charging circuit to deliver current pulses in the load circuit so that at least 50% (and more preferably at least 90%) of the energy stored in the charging circuit is delivered to the load circuit. Such current pulses can be used to enhance the rate, intensity and/or power of inductive heating delivered by a heating element and/or enhance the lifetime or reduce the cost in complexity of an inductive heating system. They are particularly useful in driving a relatively highly damped load, e.g., having a damping ratio in the range of 0.01 to 0.2, and more specifically in the range of 0.05 to 0.1, where the damping ratio, denoted by the Greek letter zeta, can be determined by measuring the amplitude of two consecutive current peaks $\alpha_1$, $\alpha_2$ in the following equation:

$$\zeta = \frac{-\ln\left(\frac{a_2}{a_1}\right)}{2\pi}$$

This damping ratio, which alternatively can be determined by measuring the amplitudes of two consecutive voltage peaks, can be used to select a desired current signal function for a particular load. The subject matter of the referenced Kagan patents/application are hereby incorporated by reference in their entirety.

These and other modifications will be readily apparent to the skilled person as included within the scope of the following claims.

The invention claimed is:

1. A method of inductively heating a solid article comprising:

providing an internal inductive heating assembly within a bore of the solid article;

the assembly comprising an interior coil inductively coupled to a portion of the article adjacent the bore to inductively heat the article;

supplying a signal to the coil to generate a magnetic flux for inductive heating of the adjacent article portion;

the assembly lacking an internal cooling mechanism; and the coil is disposed in a dielectric and thermally conductive material, wherein the coil is in thermal communication with the adjacent article portion for transmission of parasitic heat generated in the coil to the article.

2. The method of claim 1, wherein:

the heating assembly further includes a flux concentrator to increase the inductive coupling between the coil and the adjacent article portion.

3. The method of claim 1, including:

limiting a maximum allowable air gap between an outer surface of the assembly and a surface of the bore to provide a desired rower density and coil operating temperature.

4. The method of claim 1, wherein:

the coil is disposed in a cast and/or packed body of the dielectric and thermally conductive material.

5. The method of claim 1, including:

adjusting the signal to vary the relative amounts of inductive heating and thermally coupled heat transmission to the article.

6. The method of claim 5, wherein:

the signal is adjusted to maintain the coil temperature within defined operating limits.

7. The method of claim 1, including:

adjusting the signal to provide an alternating heating and cooling cycle.

8. The method of claim 7, wherein:

the coil stabilizes in temperature during the cooling portion of the cycle.

9. The method of claim 1, including:

the signal comprises current pulses providing high frequency harmonics in the coil.

10. The method of claim 1, wherein:

the solid article is a ferromagnetic material.

11. The method of claim 1, wherein:

the supplied signal to the coil drives a damped load having a damping ratio in the range of 0.01 to 0.2.

12. The method of claim 1, wherein:

an air gap is provided between the assembly and the bore is sized to provide the thermal communication and transfer of the parasitic heat to the adjacent article portion.

13. The method of claim 1, wherein:

the coil is provided in a dielectric and thermally conductive ceramic body which comprises an outer element of the assembly.

14. The method of claim 1, wherein;

the assembly includes a substantially paramagnetic and electrically insulative outer cover over a dielectric material surrounding the coil.

15. The method of claim 1, wherein:

a non-electrically conductive flowable material is provided between the heating assembly and the bore.

16. The method of claim 15, wherein:

the flowable material is a polymer.

17. The method of claim 1, wherein:

the bore is provided in an injection molding system.

18. The method of claim 17, wherein:

the bore is provided in the gate area of a nozzle.

19. The method of claim 18, wherein:

the bore is provided in a gate insert.

* * * * *

UNITED STATES PATENT AND TRADEMARK OFFICE

CERTIFICATE OF CORRECTION

PATENT NO. : 7,449,663 B2
APPLICATION NO. : 11/505023
DATED : November 11, 2008
INVENTOR(S) : Valery Kagan et al.

It is certified that error appears in the above-identified patent and that said Letters Patent is hereby corrected as shown below:

Col. 6,
In claim 3, line 8, “rower” should be “power”.

Signed and Sealed this

Tenth Day of March, 2009

JOHN DOLL
*Acting Director of the United States Patent and Trademark Office*